US005511673A

United States Patent [19]

Folk

[11] Patent Number: 5,511,673

[45] Date of Patent: Apr. 30, 1996

[54] STORAGE RACK FOR MECHANICAL DRIVE SOCKETS

[76] Inventor: Randall W. Folk, 17483 Farm School Rd., Davis, Ill. 61019

[21] Appl. No.: 294,161

[22] Filed: Aug. 22, 1994

[51] Int. Cl.[6] ..... A47F 7/00

[52] U.S. Cl. ..... 211/70.6; 206/378; 211/59.1

[58] Field of Search ..... 206/378; 211/70.6, 211/59.1, 89; 248/309.2

[56] References Cited

U.S. PATENT DOCUMENTS

| | | | |
|---|---|---|---|
| 1,712,473 | 5/1929 | McWethy | 206/378 |
| 4,337,860 | 7/1982 | Carrigan | 211/70.6 X |
| 4,421,230 | 12/1983 | Stanton | 206/378 |
| 4,621,738 | 11/1986 | Delucchi | 206/378 X |
| 4,688,672 | 8/1987 | Pemberton | 211/70.6 X |
| 4,717,106 | 1/1988 | Bies et al. | 211/70.6 X |
| 4,826,021 | 5/1989 | Burrell | 211/70.6 |
| 5,228,570 | 7/1993 | Robinson | 211/70.6 X |
| 5,398,823 | 3/1995 | Anders | 211/70.6 |

*Primary Examiner*—Robert W. Gibson, Jr.
*Attorney, Agent, or Firm*—Henderson & Sturm

[57] ABSTRACT

A storage rack for mechanical drive sockets comprising a set of rods upon which the sockets are placed when not in use. The rods are affixed upon a platform in rows and correspond to the graduated sizes of the various sockets. Each rod may have a snap ring which serves to additionally secure the socket upon the rod. Further, each rod has the socket size clearly marked thereon to facilitate socket identification. A particular embodiment may store a single drive size and socket length, or may store various combinations thereof.

5 Claims, 3 Drawing Sheets

STORAGE RACK FOR MECHANICAL DRIVE SOCKETS

TECHNICAL FIELD

This invention relates to storage devices for mechanical tools, and more particularly to a device for storing and identifying mechanical drive sockets.

BACKGROUND ART

One of the most common and popular tools in use today is the socket wrench. These tools are comprised of a socket driver or handle and a set of sockets of various sizes. Socket drivers are generally available in several different drive sizes, and the sockets are also available in both shallow and deep well types.

A complete tool set can often contain dozens of sockets which are ordinarily stored in socket trays according to their sizes. These trays are unsatisfactory in that the sockets invariably get mixed up and the trays occasionally overturn, with the numerous types and sizes of sockets rolling on the floor in all directions. A second problem is that sockets are identified as to their size only by a small stamped indication on the socket itself. These identifications become difficult to read after the socket has been used for an extended period, and while an experienced mechanic can often identify a socket size by sight, even he will waste a great deal of time by selecting the wrong socket size for a particular job.

DISCLOSURE OF THE INVENTION

The present invention discloses a storage rack for sockets comprising a set of rods upon which the sockets are placed when not in use. The rods are affixed upon a planar base in rows and correspond to the graduated sizes of the various sockets. Each rod may have a snap ring which serves to additionally secure the socket upon the rod. Further, each rod has the socket size clearly marked thereon to facilitate socket identification. A particular embodiment may store a single drive size and socket length, or may store various combinations thereof.

BRIEF DESCRIPTION OF THE DRAWINGS

These and other attributes of the invention will become more apparent upon a thorough study of the following description of the best mode for carrying out the invention, particularly when reviewed in conjunction with the drawings, wherein.

BEST MODE FOR CARRYING OUT THE INVENTION

Figure 1:
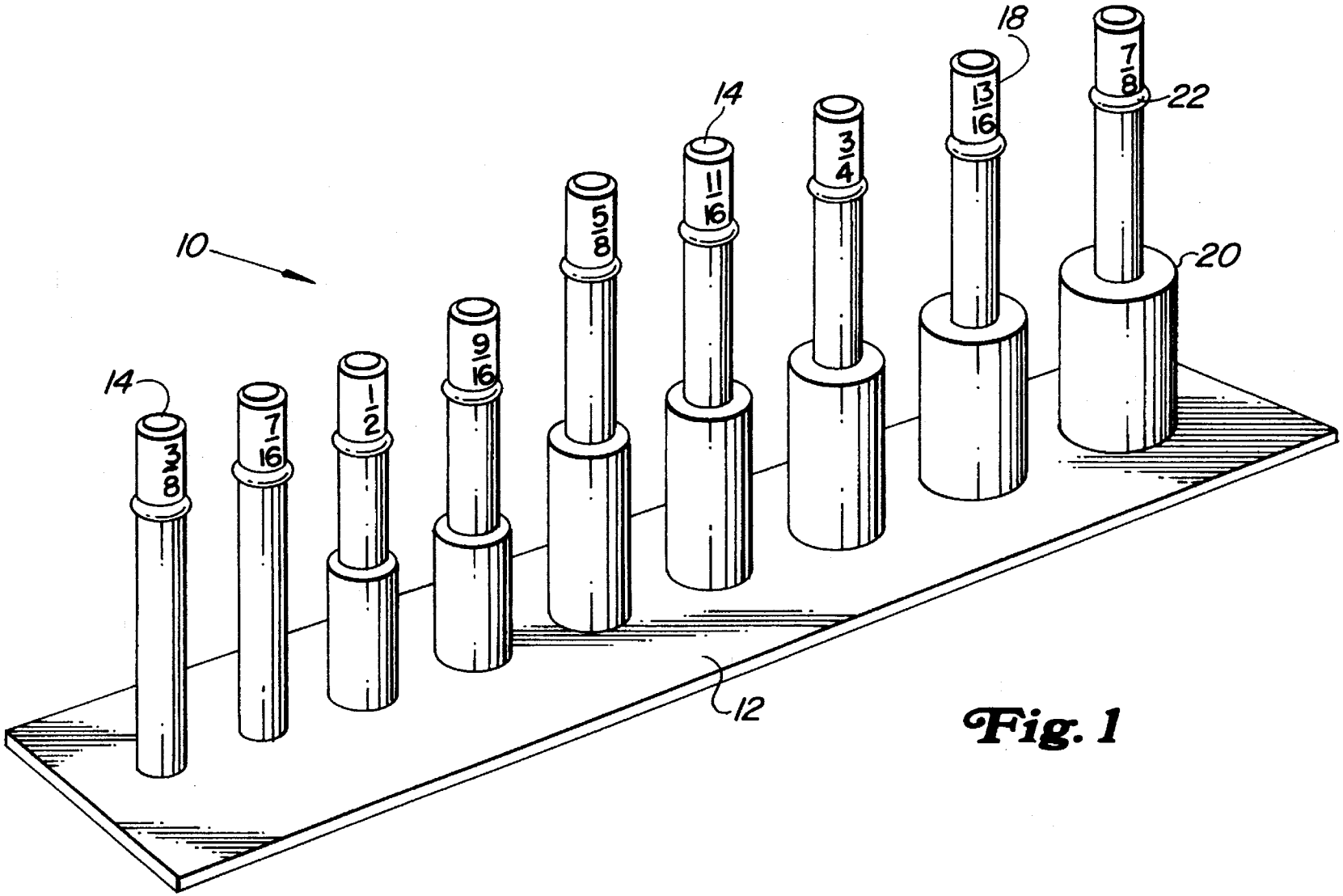
FIG. 1 is a perspective view of a first embodiment of the invention.

Referring now to the drawings, wherein like reference numerals designate identical or corresponding parts throughout the several views, a perspective view of a first embodiment of the invention is depicted at 10 in FIG. 1. A planar base 12 supports a series of rods 14 which extend substantially perpendicular to the base 12. The base 12 and rods 14 may be fabricated from molded plastic, wood, or any other appropriate material having similar properties.

Figure 2:
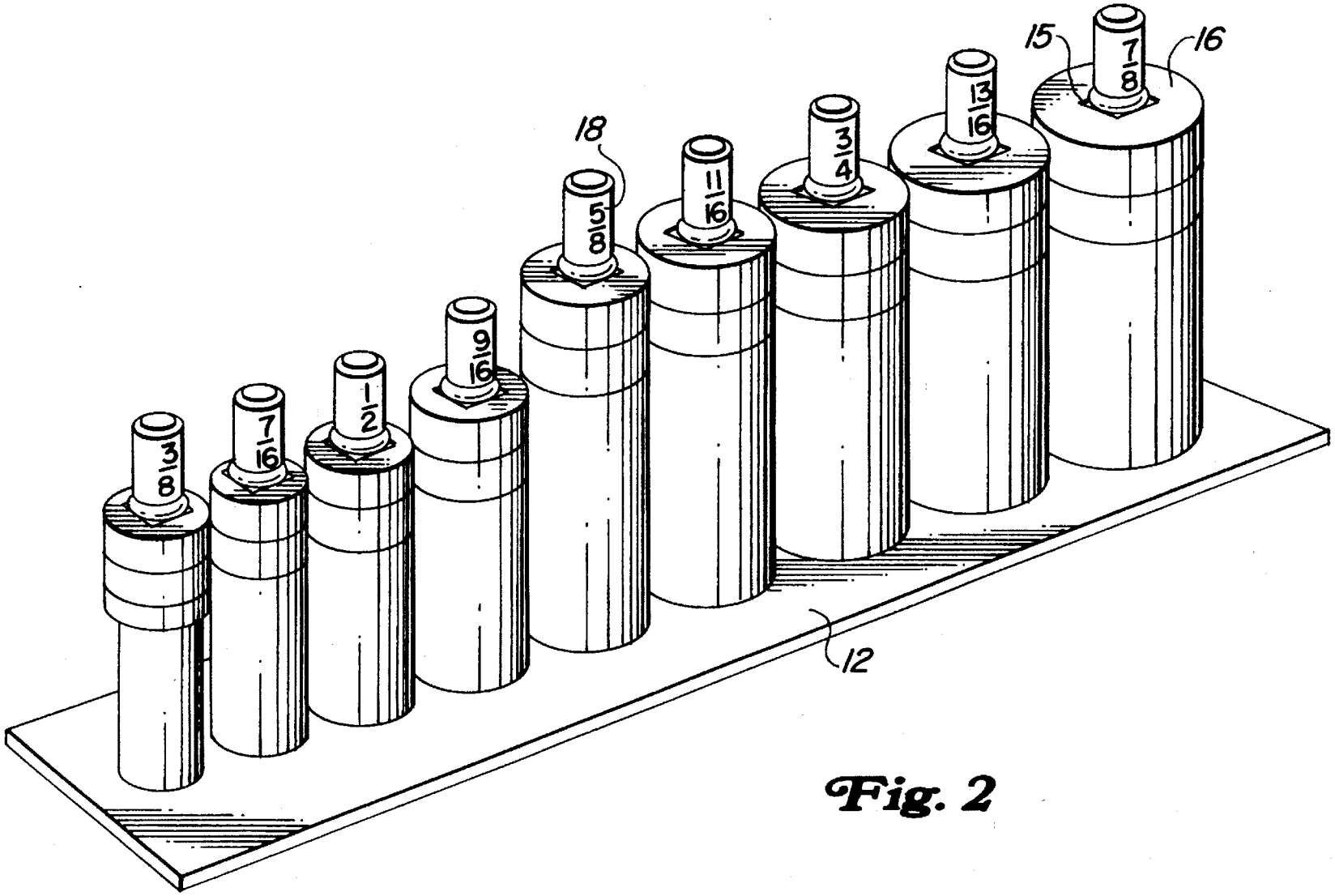
FIG. 2 is a perspective view of the first embodiment with sockets stored thereon.

Referring also to FIG. 2, the rods 14 have a diameter at their upper ends which corresponds to the size of the socket drive 15 for the sockets 16 to be stored. Typical socket drive sizes are ¼ inch, ⅜ inch and ½ inch. Further, the length of each rod is such as to permit the end of the rod to extend from the top of its respective socket 16 when the socket is placed over the rod 14. This permits a socket size identification number 18, placed on or adjacent the end of each rod 14, to be displayed for convenient indication of the size of each of the sockets 16. For larger diameter sockets, the respective rods may have a base 20 with a larger diameter which corresponds to the inside diameter of its socket. This would function to hold the socket more snugly on the rod and would be especially useful if the storage rack is to be mounted on a wall. For wall mounting, it would be desirable to have the socket identification numbers 18 located on the ends of the rods.

Each rod 14 may have a snap ring 22 located near the upper end of the rod at a distance above the support base 12 slightly greater than the length of the socket to be stored thereon. This snap ring 22 may be a molded ridge of plastic on molded plastic storage racks, or may be of other appropriate resilient material for storage racks fabricated from other materials. The function of the snap ring 22 is of course to removably secure the sockets upon the rods.

Figure 3:
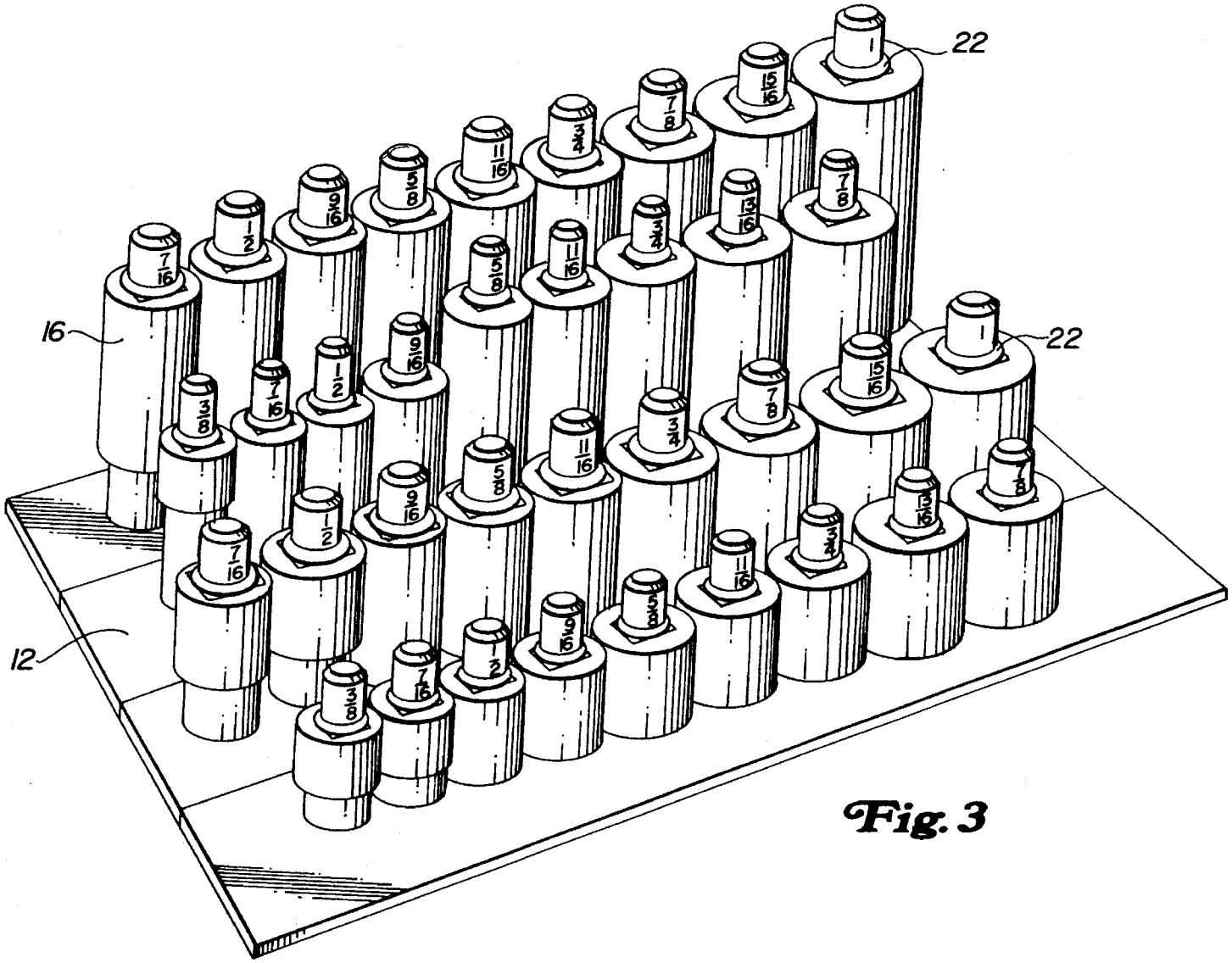
FIG. 3 is a perspective view of a second embodiment of the invention with sockets stored thereon.

A second embodiment of the invention is depicted in FIG. 3 which accommodates a socket set having two different drive sizes, each of which includes shallow and deep well sockets. Further embodiments of the invention may accommodate socket sets having any number of drive sizes, different socket depths, and any number of sockets. It should therefore be understood that numerous changes may be made in the details of construction and the arrangement of the components without departing from the spirit and scope of this disclosure. It is intended that the invention not be limited to the embodiments specifically set forth herein for purposes of exemplification, but is limited only by the scope of the appended claims including the full range of equivalency to which each element thereof is entitled.

What is claimed is:

1. A storage rack for mechanical drive sockets, comprising:

(a) a support base; and (b) a plurality of rods having a first end and a second end, said rods affixed at their first end to said support base and extending substantially perpendicular therefrom to receive the mechanical drive sockets, said rods being marked with indications of the size of the sockets to be stored thereon, and said rods having a first diameter and a second diameter, said first diameter substantially conforming to the socket drive size and said second diameter substantially conforming to the size of the socket to be stored thereon, wherein said rods include means for removably securing a socket thereon comprising a snap ring.

2. The storage rack as recited in claim 1 wherein said indications of size are disposed external to the sockets when the sockets are stored on said rods.

3. The storage rack as recited in claim 1 wherein said rods have a plurality of first diameters whereby sockets having a variety of drive sizes may be stored thereon.

4. A storage rack for mechanical drive sockets, comprising:

(a) a support base; and (b) a plurality of rods having a first end and a second end, said rods affixed at their first end to said support base and extending substantially perpendicular therefrom to receive the mechanical drive sockets, said rods being marked with indications of the size of the sockets to be stored thereon, and said rods have a first diameter and a second diameter, said first diameter substantially conforming to the socket drive size and said second diameter substantially conforming to the size of the socket to be stored thereon, wherein said rods include means for removably securing a socket thereon, wherein said rods have a plurality of first diameters whereby sockets having a variety of drive sizes may be stored thereon.

5. The storage rack as recited in claim 4 wherein said indications of size are disposed external to the sockets when the sockets are stored on said rods.

* * * * *